United States Patent [19]

Marangoni

[11] Patent Number: 4,846,082

[45] Date of Patent: Jul. 11, 1989

[54] TIRE CARCASS PYROLYSIS SYSTEM

[76] Inventor: Carlo Marangoni, Via Abetone, 51 - 38068 Rovereto (Trento), Italy

[21] Appl. No.: 181,910

[22] Filed: Apr. 15, 1988

[30] Foreign Application Priority Data

Apr. 17, 1987 [IT] Italy ..... 82205 A/87

[51] Int. Cl.[4] ..... F23B 7/00

[52] U.S. Cl. ..... 110/234; 110/162; 110/170; 110/247; 110/258

[58] Field of Search ..... 110/247, 258, 234, 170, 110/162

[56] References Cited

U.S. PATENT DOCUMENTS 3,964,675 6/1976 Euchner, Jr. ..... 110/162 X
4,388,876 6/1983 Burton ..... 110/247 X
4,633,849 1/1987 Knox ..... 110/247 X
4,718,357 1/1988 Wang et al. ..... 110/258 X
4,753,181 6/1988 Sosnowski ..... 110/234 X

*Primary Examiner*—Edward G. Favors
*Attorney, Agent, or Firm*—Bucknam and Archer

[57] ABSTRACT

The system comprises a pyrolysis chamber having a tire carcass inlet port and communicating with at least a duct for supplying combustion air, the pyrolysis chamber further communicating with s steam generator and having a stationary bottom of frustum of cone shaped coaxially communicating with the combustion air duct, rotating arm members being moreover provided, associated with the stationary bottom, adapted to cause waste unburnt material to be discharged from an outlet port formed through the stationary bottom.

3 Claims, 2 Drawing Sheets

TIRE CARCASS PYROLYSIS SYSTEM

BACKGROUND OF THE INVENTION

The present invention relates to a pyrolysis system which has been specifically designed for the pyrolysis of tires, which system is provided with cleaning means and means for automatically reviving combustion.

As is known worn tire carcass material can be burnt to provide useful power, for example in the form of pressurized hot steam.

To the end large size burning systems have been already designed which, because of the large size and weight of the main components thereof, must be constructed in situ and in which the problems of reviving combustion and removing the steel cords included in the tires being burnt have been solved by mounting the tire combustion chamber, essentially consisting of a cylindrical drum, on a rotating supporting system, able of rotating about a near horizontal axis which substantially coincides with the geometrical axis of the combustion chamber.

A rotating combustion chamber having a very great size and weight, however, requires very complex and expensive driving means, as well as thermal insulation means, and, because of these reasons, the duration of these rotating chambers is rather short.

Stationary combustion chamber systems are also known which, however, are affected by further drawbacks, the most important of which are that the combustion can be hardly revived and that the metal waste cord included in the modern tires can be hardly removed from the carcass material being burnt.

SUMMARY OF THE INVENTION

Accordingly, the main object of the present invention is to overcome the above mentioned drawbacks by providing a tire pyrolysis system which is very efficient and reliable.

Another object of the present invention is to provide a pyrolysis system comprising means for continuously and automatically reviving the combustion of the tires as well means for automatically removing all of the unburnt material, such as steel cords and the like.

Another object of the present invention is to provide a tire pyrolysis system which has a comparatively reduced size and which can be constructed starting from easily commercially available elements and materials susceptible to be pre-assembled.

According to one aspect of the present invention, the above mentioned objects, as well as yet other objects, which will become more apparent hereinafter, are achieved by a tire pyrolysis system, provided with cleaning means and means for automatically reviving the tire combustion, characterized in that said tire pyrolysis system comprises a tire pyrolysis chamber communicating with at least a duct for supplying combustion air and a port for supplying tire carcass material, said pyrolysis chamber further communicating with a steam generator and including a frustum of cone shaped stationary bottom therewith coaxially communicates said at least a duct, said bottom being associated with rotating means and coupled to at least a tubular arm which extends near said bottom and leads to the periphery thereof, through said bottom there being provided a discharging outlet for discharging unburnt materials from said tire pyrolysis chamber.

BRIEF DESCRIPTION OF THE DRAWINGS

Further characteristics and advantages of the present invention will become more apparent hereinafter from the following detailed description of a preferred, though not exclusive, embodiment of a tire pyrolysis system according to the invention which is illustrated, by way of an indicative but not limitative example, in the figures of the accompanying drawings, in which.

DESCRIPTION OF THE PREFERRED EMBODIMENTS

Figure 1:
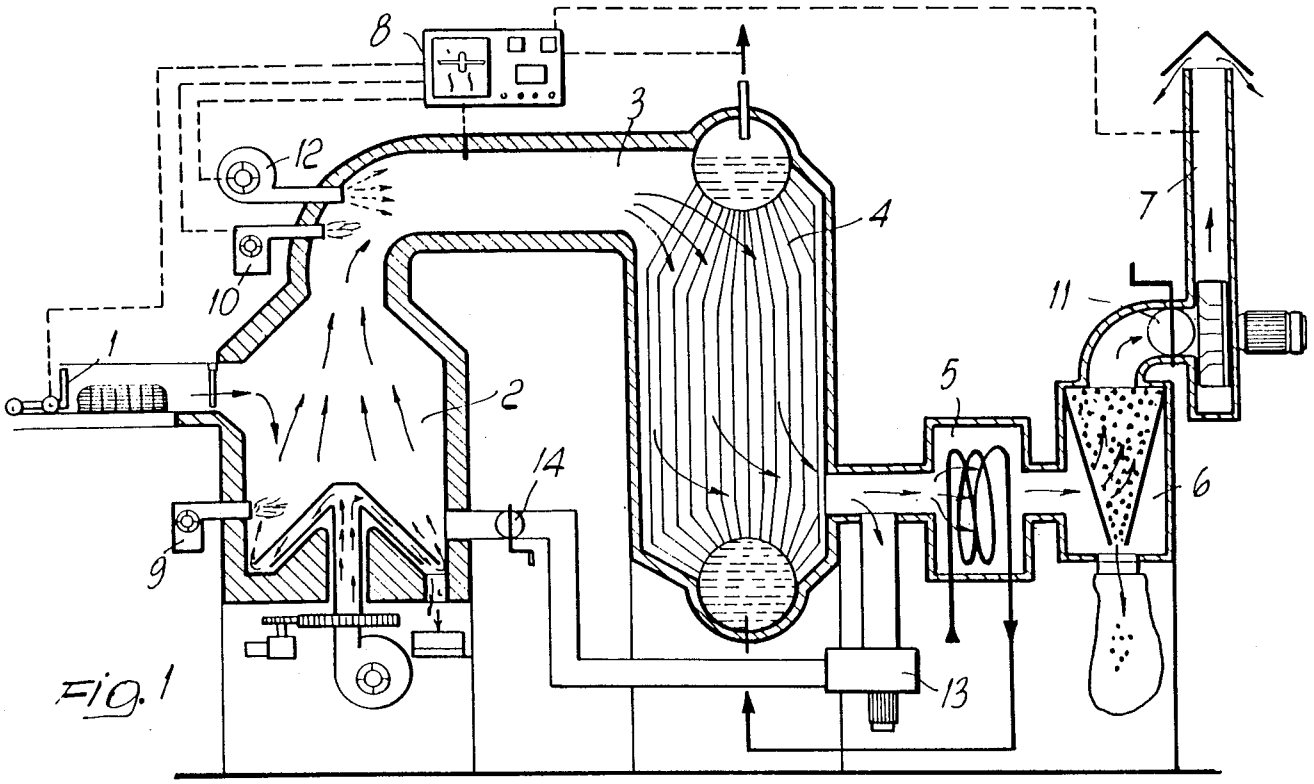
FIG. 1 is a schematic cross-sectional view illustrating the tire pyrolysis system according to the present invention.

With reference to the figures of the accompanying drawings, the tire pyrolysis system provided with cleaning means and means for automatically reviving the combustion of the tires, according to the present invention, comprises a pyrolysis chamber 2 communicating with a combustion air inlet duct 16, which will be disclosed in a more detailed way hereinafter, and a tire carcass material inlet port thereat a reciprocating carraige 1 operates for supplying said pyrolysis chamber with the tires to be burnt.

At the top of the mentioned pyrolysis chamber 2 a further duct 3 extends which communicates the pyrolysis chamber 2 with a steam generator, said duct 3 being so designed and arranged as to form an extension of the pyrolysis chamber.

The steam generator 4 is provided with a tube nest coupling a lower chamber to a upper chamber, therein there is arranged water to be vaporized; during the operation of the system, the combustion or fuel gases will release the main portion of their thermal contents to a secondary loop consisting of the tube nest, in order to generate steam by indirectly heating the water circulating inside said tube nest which is so arranged and sized as to fully exploit the combustion gas heat.

Downstream of the steam generator 4 there is provided a heat exchanger, indicated at 5, which operates to further exploit the residue heat of said flue or combustion gases. This heat exchanger consists of an apparatus like the steam generator, but of less size, and it has usually a double function of preheating the steam generating water and further reducing the fume temperature so as to supply the fume cleaning apparatus 6 with fumes of comparatively low and safe temperature.

More specifically the fume cleaning apparatus 6 is also able, in addition to properly cleaning the combustion fumes, to recover possible raw unburn materials to be recycled to further chemical processes.

As shown, the fume cleaning apparatus 6 communicates with a stack 7 provided for discharging the cleaned fumes into the atmosphere and further comprises a fan provided for holding the system under a partial vacuum to supply the combustion or pyrolysis chamber with the combustion supporting air and for providing a constant combustion fume flow rate through the overall system.

According to the invention, the pyrolysis system is controlled by an electronic central controlling unit 8 adapted to properly control and adjust all of the operating parameters of said system.

In order to hold at an optimum set value the steam generator supplying gas temperature, in the post-combustion zone at the inlet of said duct 3, there is provided a secondary-fuel burner 10 which is also able of operating as a heater during the system starting step and which automatically operates only as the temperature at the inlet of the steam generator decreases under a precisely set value even if the combustion chamber is in a saturation condition.

In order to hold the proper vacuum condition in the combustion or pyrolysis chamber, there is provided an automatic gate adjusting device 11, which is arranged downstream of the cleaning apparatus 6, whereas a possible lacking of oxygen in the combustion supporting gas is compensated by a fan 12 which is arranged in the duct 3, and a possible low speed of the combustion fumes is compensated by a further fan 13 which is controlled by a gate 14 adapted to remove the gases downstream of the steam generator 4 and supply the removed gases to the pyrolysis chamber, in order to increase the gas current flow rate.

A main feature of the present invention is that the combustion or pyrolysis chamber is provided with a frustum of cone shaped bottom 15 which coaxially communicates with the combustion air inlet duct 16, coupled to rotating means 17 able of rotating it about its axis.

Combustion air is supplied by means of a main fan 18 supplying with air the combustion air inlet duct 16, which defines two converging tubular arms 19 provided for scraping the frustum of cone shaped bottom 15.

More specifically, the arms 19 continuously entrain and displace the tires being burnt so as to increase the combustion air amount supplied to said burning tires, said arms being also so designed and arranged as to cause steel cords and other unburnt materials to be ejected from the discharging opening or port 20, provided at the periphery of the bottom 15, which steel cords and unburnt materials will be conveyed by an endless conveyor 21 away from the system.

During the operation of the pyrolysis system, after having reached a minimum temperature of 600°–700° C., by burning secondary fuel materials, such as naphta, gases and the like by means of the burners 9 and 10, the system is started by an electric command sent to the central control unit 8; in this way the system will be able of automatically operating, the operating parameters being continuously monitored by a plurality of sensors (not shown).

In this connection it should be pointed out that the operation of the system will depend on the following operating parameters :the temperature in the combustion or pyrolysis chamber, the saturation status of the steam generator, the vacuum conditions in the combustion air supplying duct, the fume or flue gas speed and the burning material/combustion air ratio.

With respect to the combustion chamber temperature the tire supply system is so designed that the tires to be burnt are supplied only if the temperature in the combustion chamber is included within a set temperature range and that the rubber material amount in said combustion chamber does not exceed a set amount, specifically selected for an optimal operation of the pyrolysis system.

In this connection, it should be pointed out that the tires to be burnt are continuously moved, in order to continuously expose to the flame new tire material, so as to efficiently control the combustion of said tires.

Moreover, in order to provide an optimal temperature for the steam generator feeding gas, the secondary fuel burner 10 is so designed and arranged as to operate automatically only if the temperature at the inlet of said steam generator decreases under a precisely set value, as above already mentioned.

Like control operations can be carried out by driving the gate 11 so as to maintain a set vacuum and control the burning oxygen amount, by operating the fan 12, and increase the flue gas rate or speed, by operating the fan 14.

During the operation of the pyrolysis system, in particular, the loading device 1, which is controlled by the central control unit 8, will supply the combustion chamber with a tire which, by gravity, will fall on the frustum of cone shaped bottom 15 which forms the floor of the combustion chamber, as indicated at 22, said supplied tire being indicated at 23.

In this connection it should be apparent that this way for supplying the tire to be burnt is very suitable for starting an efficient tire combustion since the linear contact between the frustum of cone shaped bottom and a face of the tire is adapted to fully expose to the burning flame all of the combustible surface.

Starting from these favorable conditions, and in order to prevent the tire carcass from collapsing and choking the flame, the rotating arms 19 will engage the burning tire so as to cause it to continuously slide against the frustum of cone shaped bottom ;in this way the friction between said bottom and the carcass tire will generate passive resistance forces able of continuously turning and/or tilting the tire, thereby continuously reviving the burning flame owing to a constant supply of combustion air through the duct 16.

Another important function of the rotating arms 19, in combination with the frustum of cone shape of the bottom, is that of continuously removing from the combustion chamber the steel chords and other unburnt materials.

In fact, as the combustible rubber which, together with the steel cords or belts forms the tire carcass, is gasified, all of the tire carcass structure tends to be deformed and slide on the frustum of cone shaped bottom and the metal parts are entrained on bottom diameters which correspond to the diameters thereat there is formed the outlet port 20.

From this moment, the mentioned rotating arms 19 will cause all of the waste materials, both of metal and non metal nature, to be expelled, which ejecting effect is aided by combustion air entering the combustion chamber through the rotating arm 19 and impinging on the flame just on the diameters thereat waste materials deposit so as to hold this region at a temperature adapted to hold in a brittle condition the steel chords which will be crushed by the rotating arms 19 to a size permitting said cords to easily passing through the outlet port or opening 20.

In order to prevent the combustion waste materials collected on the edges of the outlet 20 from progressively choking this outlet, a cleaning device has been provided adapted to clean waste material away from said outlet.

More specifically, this cleaning device comprises a swinging operating arm 24 pivoted, through the pivot pin 25, on the outside of the combustion chamber, and the end portion of which, indicated at 26, is able to engage the outlet 20 edge for removing cyclically therefrom the built in waste material.

In this connection it should be apparent that said rotating arms are so designed and arranged that said end portion 26 can easily reach the combustion chamber.

At the reference number 28 there has been indicated the cleaning device driving member which can consist of an electric motor or pneumatic means or any other suitable driving means.

Figure 2:
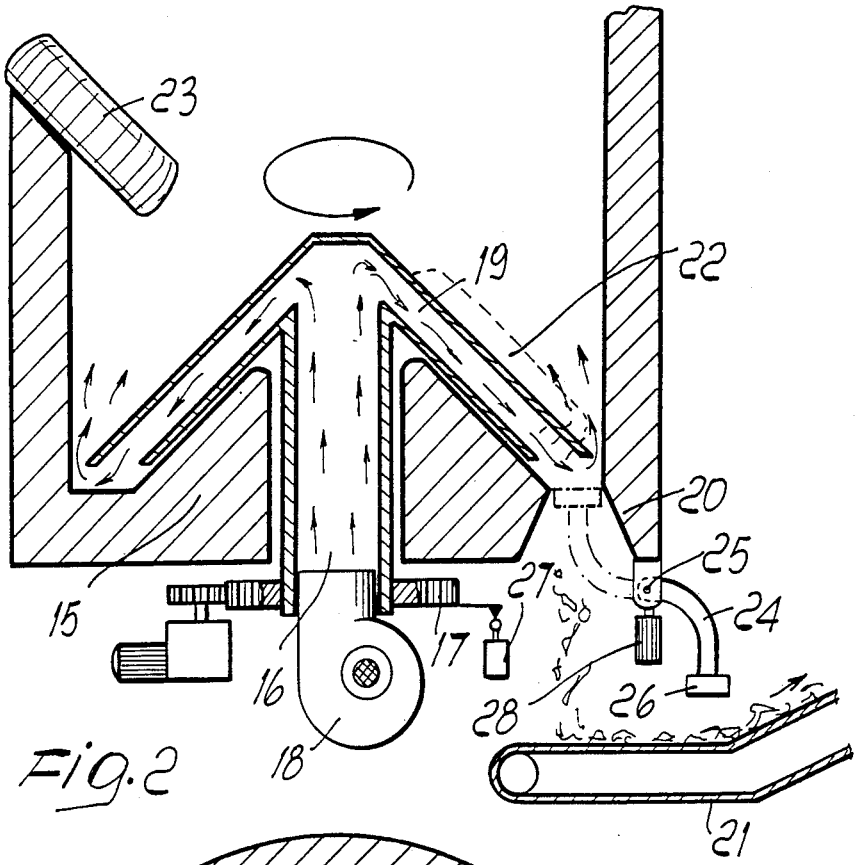
FIG. 2 is a vertical cross-section of the pyrolysis chamber included in the tire pyrolysis system according to the present invention.
Figure 3:
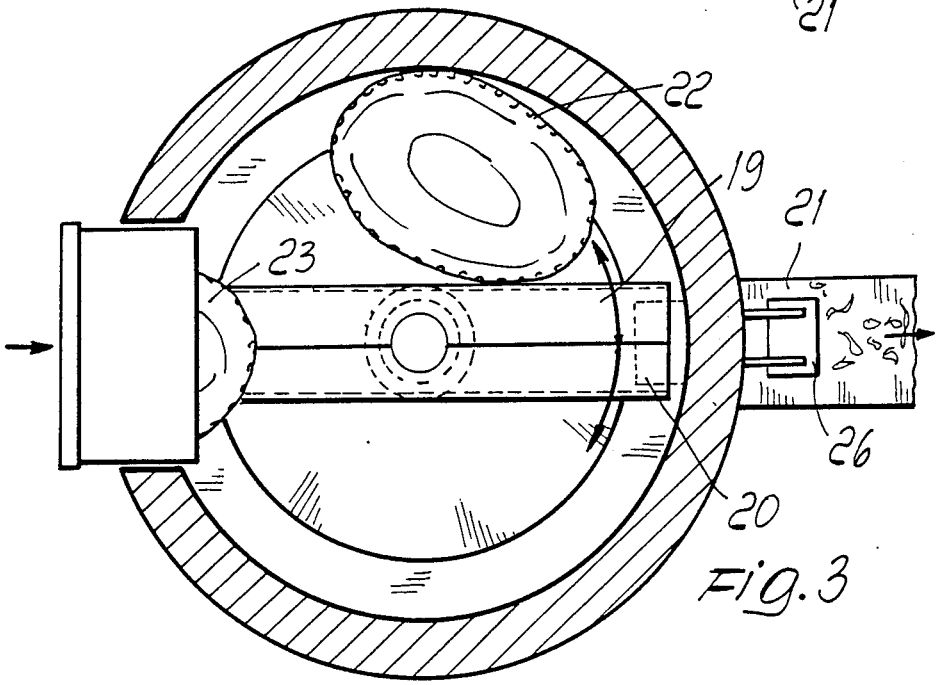
FIG. 3 is a horizontal cross-section view of the pyrolysis chamber.

FIGS. 2 and 3, in particular, show the cleaning device at a rest condition, and the operating condition of this device is shown in FIG. 2 by the broken line.

The rotating arms 19 can be made of a refractory metal material and they are held at a suitable not destructive temperature by the air impinging thereon through the fan 18.

While the invention has been disclosed and illustrated with reference to a preferred embodiment thereof, it should be apparent that the disclosed embodiment is susceptible to several modifications and variations all of which will come within the spirit and scope of the appended claims.

What is claimed:

1. A tire pyrolysis system provided with cleaning means and means for automatically reviving the tire combustion, comprising a tire pyrolysis chamber communicating with at least a duct for supplying tire carcass material, said pyrolysis chamber further communicating with a steam generator and including a frustum of cone shaped stationary bottom having a coaxial duct communicating therewith for supplying tire burning air supplied by a main fan, said burning air supplying duct being rotated by rotating means and defining two converging rotating scraping tubular arms extending near said bottom and leading to the periphery of said bottom, a discharging outlet being moreover provided for discharging unburnt materials from said tire pyrolysis chamber.

2. A system according to claim 1, wherein said system comprises a coupling duct coupling said pyrolysis chamber and steam generator, said coupling duct forming an extension of said pyrolysis chamber, downstream of said stream generator there being provided a heat exchanger adapted to pre-heat the water supplied to said steam generator and to reduce the temperature of said flue gas, downstream of said heat exchanger there being provided a flue gas cleaning device and downstream of said flue gas cleaning device there being provided a flue gas exhausting stack, comprising therein a gate member for adjusting the vacuum in said pyrolysis chamber, said system further including a first fan arranged in said coupling duct at one end of said pyrolysis chamber to supply oxygen to said flue gas, and a second fan to suck said flue gas downstream of said steam generator and send sucked flue gas to said pyrolysis chamber, through a duct coupling with a closed loop configuration said steam generator to said pyrolysis chamber.

3. A system according to claim 1, comprising a cleaning device arranged at said discharging outlet to remove therefrom ejected waste materials so as to prevent said discharging outlet from being blocked, said cleaning device comprising a swinging arm pivoted on an outside wall of said pyrolysis chamber, and having an enlarged end portion to scrape away from said discharging outlet said ejected waste materials.

* * * * *